United States Patent [19]

Jenz et al.

[11] Patent Number: 4,738,228

[45] Date of Patent: Apr. 19, 1988

[54] COOLING SYSTEM BALANCING RESERVOIR

[75] Inventors: Siegfried Jenz, Illingen; Helmut Dobler, Hemmingen, both of Fed. Rep. of Germany

[73] Assignee: Suddeutsche Kuhlerfabrik, Julius Fr. Behr GmbH & Co., KG, Sutttgart, Fed. Rep. of Germany

[21] Appl. No.: 902,681

[22] Filed: Sep. 2, 1986

[30] Foreign Application Priority Data

Sep. 17, 1985 [DE] Fed. Rep. of Germany ..... 3533094

[51] Int. Cl.[4] ..... F01P 11/02

[52] U.S. Cl. ..... 123/41.51; 123/41.27

[58] Field of Search ..... 123/41.27, 41.51, 41.54; 165/104.27, 104.32

[56] References Cited

U.S. PATENT DOCUMENTS 3,193,041 7/1965 Peras ..... 123/41.54

3,757,984 9/1973 Barton ..... 123/41.54

4,480,598 11/1984 Berrigan ..... 123/41.27

FOREIGN PATENT DOCUMENTS 2852725 6/1980 Fed. Rep. of Germany .

3430115 1/1986 Fed. Rep. of Germany .

2312645 12/1976 France .

*Primary Examiner*—Tony M. Argenbright

*Assistant Examiner*—Eric R. Carlberg

*Attorney, Agent, or Firm*—Barnes & Thornburg

[57] ABSTRACT

A expansion tank for coolant consists of a filling chamber for receiving the coolant and an expansion chamber that is arranged under the filling chamber and is connected with it via a line between the upper area of the filling chamber and the lower area of the expansion chamber. An indentation portion of the filling chamber extends to the underside of the expansion tank and a suction outlet is connected to the indentation portion adjacent the underside of the expansion tank.

19 Claims, 1 Drawing Sheet

COOLING SYSTEM BALANCING RESERVOIR

BACKGROUND AND SUMMARY OF THE INVENTION

This invention relates to an expansion tank for the coolant of a coolant circulating system of an intenal-combustion engine having a filling chamber for receiving the coolant, an expansion chamber that is separated from it by means of a partition and a connecting line that connects an upper area of the filling chamber with a lower area of the expansion chamber.

A coolant expansion tank of this type is known from DE-OS 28 52 725. There the tank, by means of a vertically arranged partition, is divided into a filling chamber and an expansion chamber. The upper area of the filling chamber, via a line, is connected to the lower area of the expansion chamber. Normally, the filling chamber is filled with coolant up to a certain level. In the case of an extensive heating and thus an expansion of the volume of the coolant, this coolant, flows from the filling chamber, via the line, into the expansion chamber and when it is subsequently cooled, is drawn back into the filling chamber by means of a vacuum. From the underside of the filling chamber of the known tank, a line leads to a suction pump which transports the taken-in coolant back into the circulating system. By dividing the known tank into a filling chamber and an expansion chamber, in the case of a high cooling liquid level in the filling tank, the possibility of cavitation phenomena of the coolant in the line leading to the pump, and thus the possibiility of the occurrence of vapor bubbles because of the vacuum generated by the pump, is reduced. However, if the coolant level in the filling chamber, because of a loss of coolant, falls to a minimal level, the danger of cavitation phenomena in the line leading to the pump is increased because of the reduced geodetic level.

It is the objective of the invention to develop an expansion tank for the coolant of the initially mentioned type in such a way that in any operating condition, thus also in the case of a loss of coolant, damage of the components to be cooled is largely impossible. This objective is achieved by arranging the expansion chamber essentially below the filling chamber.

By means of this arrangement, even in the case of a coolant loss resulting in a lowering of the coolant level of the filling chamber, coolant still exists up to the level of the expansion chamber located under the filling chamber above the line leading to the pump and thus, because of the still relatively high geodetic level, cavitation phenomena in the pipe are reduced.

In the case of an advantageous development of the invention, the connecting line at the connecting point to the upper area of the filling chamber is developed into an air space, the highest point of which is located above the highest point of the filling chamber. In addition, it is possible to shape the connecting line at the connecting point to the lower area of the expansion chamber into a collecting space, the lowest point of which is located under the lowest point of the expansion chamber. By this measure, even when the filling chamber is completely filled with coolant, the air space is not filled with liquid and therefore a separation of gas from the coolant of the expansion chamber into this air space is possible. By means of the collecting space at the connecting point to the expansion chamber, all coolant from the expansion chamber can be sucked back into the filling chamber by means of a vacuum.

In the case of another advantageous development of the invention, a valve connection piece is located at the upper side of the tank that, by means of a duct, is connected with the expansion chamber and that can be closed by means of a valve cap having a pressure control valve. When the pressure in the expansion chamber rises above a certain value, the pressure control valve opens and discharges gas, to limit the pressure in the whole coolant circulating system.

An advantageous further development of the invention provides a suction connection piece that is located at the underside of the tank and that, via a connection, particularly an indentation developed by means of a slope, is connected to the filling chamber. By means of this suction connection piece, coolant is let off from the filling chamber.

It is especially advantageous to develop the partition between the filling chamber and the expansion chamber essentially horizontal. It is also advantageous to mount the connecting line at a tank wall. Because of these measures, it is possible, in the case of a vertical division of the whole tank into two shells, to produce these two parts by means of an injection process of plastic and to fit them together by means of corresponding connecting methods. The resulting division joint will then intersect the connecting line, making possible a simple shaping-out of this connecting line.

Other objects, advantages and novel features of the present invention will become apparent from the following detailed description of the invention when considered in conjunction with the accompanying drawings.

DETAILED DESCRIPTION OF THE DRAWINGS

It is known to connect an expansion tank in parallel to the actual coolant circulating system with the heat exchanger and the internal-combustion engine. This tank has the objective of catching expansions of the coolant occurring because of heating. In addition, by means of a lower circulating speed of the coolant in the expansion tank, a gas separation becomes possible so that gas bubbles that may have formed in the coolant circulating system are eliminated in the expansion tank. With respect to its height, the expansion tank is arranged in the motor vehicle above the heat exchanger and the internal-combustion engine so that, when coolant is lost, the coolant level in the expansion tank will fall first without changing the coolant level in the heat exchanger. In order to avoid the cavitation phenomena that may occur during the taking-in of coolant from the expansion tank into the internal-combustion engine of the motor vehicle, it is also important that the coolant level in the expansion tank be as high as possible in order to lower the suction vacuum. Finally, regarding the design of an expansion tank for coolant, it must also be observed that usually little space exists in the engine space of the motor vehicle and therefore arbitrary designs of the tank are not possible.

Figure 1:
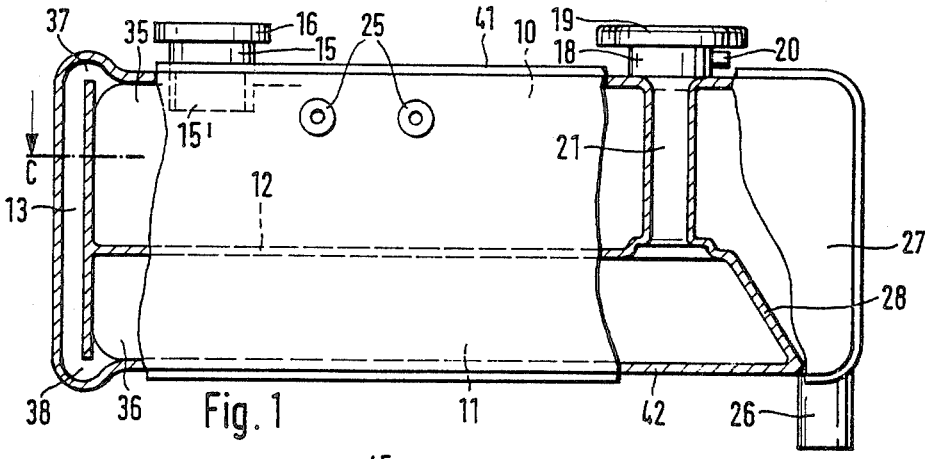
FIG. 1 is a partially cut lateral view of the expansion tank according to the invention.

The expansion tank for coolant shown in FIG. 1 consists mainly of a fluid or filling chamber 10 and an air or expansion chamber 11. Both chambers 10 and 11 are separated from one another by a horizontal partition 12 and are located above one another. An upper area 35 of the filling chamber 10, via a connecting line or conduit 13, is connected with a lower area 36 of the expansion chamber 11. The connecting line 13, at the connecting point with the upper area 35 of the filling chamber 10, has an air space 37, the highest point of which is located above the highest point of the filling chamber 10. Also, at the connecting point of the connecting line 13 with the lower area 36 of the expansion chamber 11, a collecting space 38 is located, the lowest point of which is located under the lowest point of the expansion chamber 11

On the upper side of the filling chamber and thus on the upper side 41 of the expansion tank, a feeding connection piece 15 is located that has a feeding limit 15' and can be closed by means of a feeding cap 16. Also, on the upper side 41 of the expansion tank, a valve connection piece 18 is located and can be closed by means of a valve cap 19. The valve connection piece 18, by means of a duct 21, is connected with the upper area of the expansion chamber 11. The valve cap 19 contains a pressure control valve (not shown) so that, when a certain pressure in the expansion chamber 11 is exceeded, this pressure control valve will open up and connect the duct 21 with an overflow pipe 20. In the upper area 35 of the filling chamber 10, two inlet connection pieces 25 are disposed through which coolant is guided to the filling chamber.

On the underside 42 of the expansion tank, a low-positioned suction connection piece 26 for the filling chamber 10 is arranged. The filling chamber 10, in the area of the suction connection piece 26, by means of a slope 28 that extends from the partition 12 to the bottom 42 of the expansion tank, is widened to form an indentation 27 that leads to the suction connection piece 26 arranged in the bottom 42.

Figure 2:
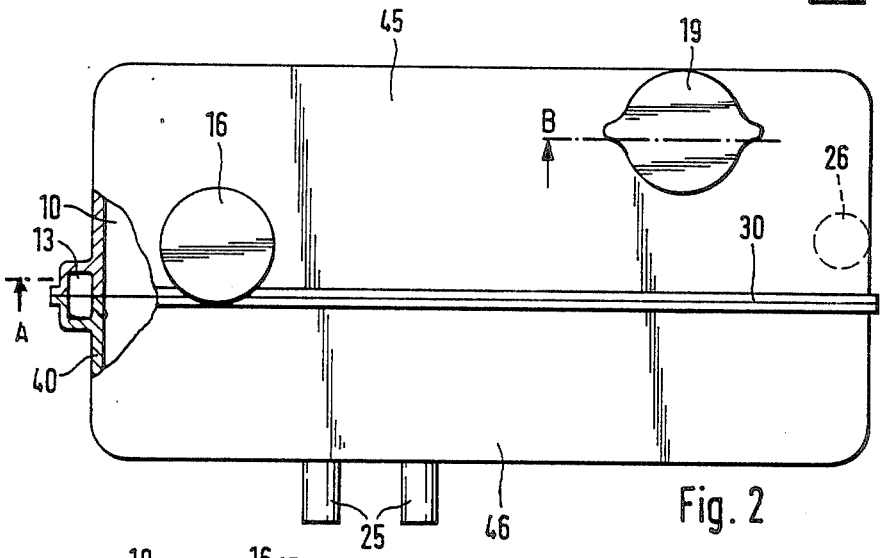
FIG. 2 is a partially cut top view of the expansion tank according to FIG. 1.

The top view of the expansion tank of FIG. 1 shown in FIG. 2 shows the position of the feeding cap 16, of the valve cap 19, of the suction connection piece 26, of the inlet connection piece 25 as the cut-open filling chamber 10 and connecting line 13. The connecting line 13 is located at an exterior wall 40, namely at a narrow side of the expansion tank, and has a rectangular cross-section. Finally, FIG. 2 shows a division joint 30 in which a first shell 45 and a second shell 46 of the expansion tank are connected. The division joint 30 also divides the connecting line 13 which, as a result, together with the pertaining shells, can be easily shaped out. It should be pointed out that the sectional area of the connecting line 13 of FIG. 1 corresponds to the Section A of FIG. 2; the sectional area of the duct 21 of FIG. 1 corresponds to the Section B of FIG. 2; and the sectional area of the connecting line 13 of FIG. 2 corresponds to the Section C of FIG. 1.

Figure 3:
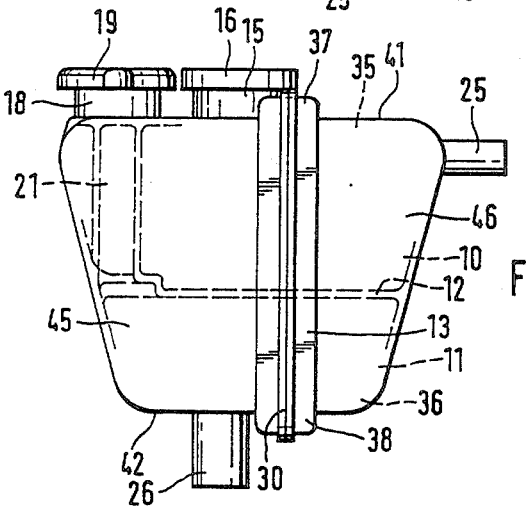
FIG. 3 is a view of the narrow side of the expansion tank according to FIGS. 1 and 2.

FIG. 3 shows the narrow side of the expansion tank of FIGS. 1 and 2. This figure indicates that the division joint 30 extends in parallel to the connecting line 13, while the partition 12 is located at a right angle to this connecting line 13 and is therefore arranged horizontally. Also, the two inlet connection pieces 25 are mounted in a horizontal position, while the feeding connection piece 15, the valve connection piece 18 and the suction connection piece 26 are essentially vertical.

If the described expansion tank is installed in a motor vehicle, the inlet connection pieces 25 are connected with the highest point of the heat exchanger and/or the highest point of the cooling jacket of the internal-combustion engine and form a ventilation for the heat exchanger and the internal-combustion engine. At the same time, the suction connection piece 26, via a line, is connected to a pump that takes in coolant from the expansion tank and feeds it into the normal coolant circulating system consisting of the heat exchanger, a pump and the cooling jacket of the internal-combustion engine. The expansion tank is installed into the motor vehicle in such a way that the feeding connection piece 15 and the valve connection piece 18 are accessible from above and the whole tank is located in a horizontal position. Via the feeding connection piece 15, coolant is filled into the filling chamber 10 of the expansion tank to the filling limit defined by the length of 15', so that a sufficient air space remains in the filling chamber for receiving the expansion volume of the coolant resulting from the heating at a normal operating temperature. In the normal case, therefore, the initial coolant level will rise because of heating and expansion but no coolant will flow over into the expansion chamber 11 via the connecting line 13.

Under extreme operating conditions, for example, at very high operating temperatures of the internal-combustion engine or also after the hot internal-combustion engine is switched off, the coolant, because of the insufficient or non-existent cooling, heats up to such an extend that, because of the resulting expansion, the coolant, via the connecting line 13, flows over from the filling chamber 10 into the expansion chamber 11. Since the expansion chamber 11 is closed off tightly by means of the valve cap 19, the pressure in the expansion chamber 11 increases so that, after a recooling of the coolant, because of the excess pressure in the expansion chamber 11 and of the resulting vacuum in the filling chamber 10, the coolant is sucked back from the expansion chamber 11 into the filling chamber 10 via the connecting line 13. For this purpose, the collecting space 38 is provided in which the coolant located in the expansion chamber 11 can collect. Similarly, a certain residual amount of air remains in the air space 37 even when the whole filling chamber 10 is again filled with coolant. As a result, any gas bubbles which may rise from the coolant in filling chamber will be eliminated into the air space 37.

When the pressure in the expansion chamber 11 exceeds a predetermined value, the pressure control valve located in the valve cap 19 opens up so that gas or fluid can flow out via the overflow line 20 and as a result, the pressure will be reduced again. In this case, it is possible to combine the mentioned pressure control valve with a vacuum valve so that, in the case of a vacuum occurring in the expansion chamber 11 that can be caused, for example, during the cooling of the coolant, air is let into the expansion chamber 11 and results in a pressure compensation.

Because the pump is connected with the suction connection piece 26 that takes in coolant from the expansion tank, there is the danger that cavitation phenomena occur in the connecting line from the expansion tank to the pump and that therefore bubbles form because of a tearing-open of the fluid flow. In order to avoid cavitation phenomena in the connecting line from the suction connection piece 26 to the pump, it is required to ensure in every operating condition, a certain coolant level above the suction connection piece 26. By means of the position of the filling chamber 10 above the expansion chamber 11, thus because of the fact that the coolant is always located in the upper area of the expansion tank, it is ensured that the fluid level is normally located sufficiently high above the suction connection piece 26. Even if, because of a loss of coolant, the coolant level in the filling chamber 10 falls, the coolant level will be sufficiently high as long as the indentation 27 is filled with some coolant. Only when the indentation 27 contains no coolant, and therefore there is no more coolant in the whole expansion tank, is there the danger of a bubble formation in the coolant and thus a reduction of the coolant performance.

In comparison to the intially described known expansion tank that has a vertical partition between the filling chamber and the expansion chamber, the expansion tank according to the invention, as it is shown, for example, in FIGS. 1 to 3, results in a significant reduction of the danger of cavitation phenomena. This is mainly achieved by the fact that in the case of an expansion tank according to the invention, the level of the expansion chamber 11, in principle, can always be added to the effective level of the fluid in the expansion chamber 10 above the suction connection piece 26. In addition, in the case of an expansion tank according to the invention, also changes in the amount of the coolant, for example, because of coolant losses, on the basis of the essentially flat structural shape of the expansion tank, will only slightly affect the filling level in the filling chamber 10 of the tank. Finally, this flat structural shape of the expansion tank that is achieved by means of the position of the filling chamber 10 above the expansion chamber 11 is also advantageous for an installation of the expansion tank into the limited engine space of a motor vehicle.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A one-piece expansion tank for the coolant of a coolant circulating system of an internal-combustion engine comprising:

a filling chamber means for receiving a coolant from said circulating system;

an expansion chamber positioned below the filling chamber and separated from it by means of a partition; and means for connecting an upper area of the filling chamber with a lower area of the expansion chamber.

2. An expansion tank according to claim 1, wherein the partition, between the filling chamber and the expansion chamber, is horizontal.

3. An expansion tank according to claim 1, wherein the connection means at the connecting point to the upper area of the filling chamber include an air space, the highest point of which is located above the highest point of the filling chamber.

4. An expansion tank according to claim 1, wherein the connecting means is intergral with an exterior wall of the tank.

5. An expansion tank according to claim 1, including a feeding connection piece connected at the upper side of the filling chamber and feeding cap closing said feeding connection piece.

6. An expansion tank according to claim 1, including a valve connection piece connected with the expansion chamber and a pressure control valve cap closing said valve connection piece.

7. An expansion tank according to claim 6, wherein the valve connection piece is located at the upper side of the filling chamber and including a duct connecting the valve connection piece to the expansion chamber.

8. An expansion tank according to claim 1, including at least one inlet connection for coolant is mounted in the upper area of the filling chamber.

9. An expansion tank according to claim 1, including a suction connection piece for coolant connecting to the filling chamber adjacent the underside of the expansion chamber via an indentation portion of said filling chamber.

10. An expansion tank according to claim 9, wherein the indentation portion include at least one slope wall extending from the partition to the underside of the expansion chamber.

11. An expansion tank according to claim 9, wherein the suction connection is located at the edge of the tank.

12. An expansion tank according to claim 1, wherein the tank includes two shells fitted together and having a vertical division joint extending through the connecting means.

13. An expansion tank according to claim 12, wherein the shells are made from plastic as an injection molded part and are welded to one another in the area of the division joint.

14. An expansion tank according to claim 5, wherein said feeding connection piece extends into said filling chamber below the top thereof for limiting the fill level of said filling chamber.

15. An expansion tank for the coolant of a coolant circulating system of an internal-combustion engine comprising:

a filling chamber for receiving a coolant;

an expansion chamber positioned below and along an underside of said filling chamber;

means for connecting an upper area of the filling chamber with a lower area of the expansion chamber;

an indentation portion of said filling chamber extending down to an under wall of said expansion chamber; and suction connection means, connected to said indentation portion adjacent the under side of said expansion chamber, for removing of coolant.

16. An expansion tank according to claim 15, wherein the indentation portion include at least one slope wall extending from an upper side to the underside of the expansion chamber.

17. An expansion tank according to claim 15, including a feeding connection piece connected at the upper side of the filling chamber and feeding cap closing said feeding connection piece.

18. An expansion tank according to claim 15, including:

a valve connection piece located at the upper side of the filling chamber;

a pressure control valve cap closing said valve connection piece; and a duct connecting the valve connection piece to the expansion chamber.

19. A one-piece expansion tank for the coolant of a coolant circulating system of an internal-combustion engine comprising:

a filling chamber for receiving a coolant;

an expansion chamber positioned below the filling chamber and separated from it by means of a partition; and means for connecting an upper area of the filling chamber with a lower area of the expansion chamber, said connecting means at the connecting point to the lower area of the expansion chamber including a collecting space, the lowest point of which is located below the lowest point of the expansion chamber.

* * * * *